US005088897A

United States Patent [19]

Kawai et al.

[11] Patent Number: 5,088,897

[45] Date of Patent: Feb. 18, 1992

[54] SWASH PLATE TYPE COMPRESSOR WITH INTERNAL REFRIGERANT AND LUBRICANT SEPARATING SYSTEM

[75] Inventors: Katsunori Kawai; Hayato Ikeda; Shinichi Ishihara; Kazuhiro Tanikawa; Naoya Yokomachi; Toshihiro Kawai, all of Kariya, Japan

[73] Assignee: Kabushiki Kaisha Toyoda Jidoshokki Seisakusho, Aichi, Japan

[21] Appl. No.: 486,154

[22] Filed: Feb. 28, 1990

[30] Foreign Application Priority Data

Mar. 2, 1989 [JP] Japan ..... 1-50491

[51] Int. Cl.[5] ..... F04B 1/12

[52] U.S. Cl. ..... 417/269; 184/6.17; 92/154; 418/DIG. 1

[58] Field of Search ..... 417/269, 271; 184/6.17; 92/154; 418/DIG. 1

[56] References Cited

U.S. PATENT DOCUMENTS

| | | | |
|---|---|---|---|
| 3,557,664 | 1/1971 | Akaike et al. | 417/269 |
| 3,833,318 | 9/1974 | Nakayama et al. | 418/DIG. 1 |
| 3,888,604 | 6/1975 | Oshima et al. | 417/269 |
| 4,086,040 | 4/1978 | Shibuya et al. | 418/DIG. 1 |
| 4,127,363 | 11/1978 | Kato et al. | 184/6.17 |
| 4,321,019 | 3/1982 | Degawa et al. | 417/269 |
| 4,392,788 | 7/1983 | Nakamura et al. | 417/269 |
| 4,444,549 | 4/1984 | Takahashi et al. | 417/269 |
| 4,712,982 | 12/1987 | Inagaki et al. | 184/6.17 |
| 4,815,943 | 3/1989 | Kawashima et al. | 417/269 |
| 5,009,286 | 4/1991 | Ikeda et al. | 184/6.17 |

*Primary Examiner*—Richard A. Bertsch
*Assistant Examiner*—Michael I. Kocharov
*Attorney, Agent, or Firm*—Burgess, Ryan & Wayne

[57] ABSTRACT

A swash plate type compressor having a compressor casing accommodating a swash plate operated compressing mechanism compressing a refrigerant gas supplied from a suction side of a refrigerant circulating circuit and discharging a compressed refrigerant gas into a discharge side of the circuit, and an internal lubricating system for lubricating movable elements of the swash plate operated compressing mechanism by using a lubricating oil reserved in a swash plate chamber and an oil sump provided in the bottom of the compressor casing, the compressor casing having a refrigerant and lubricant separating chamber for separating a lubricant component from a lubricant suspended refrigerant gas generated in the swash plate chamber by a high pressure blow-by refrigerant gas and a mist of the lubricant oil when the gas flows from the swash plate chamber toward the suction side of the refrigerant gas circulating circuit, and a refrigerant gas evacuation passageway extended from the refrigerant and lubricant separating chamber to the suction side of the refrigerant circulating circuit to permit an evacuation of the refrigerant gas after the lubricant separation.

7 Claims, 11 Drawing Sheets

SWASH PLATE TYPE COMPRESSOR WITH INTERNAL REFRIGERANT AND LUBRICANT SEPARATING SYSTEM

BACKGROUND OF THE INVENTION

1. Field of The Invention

The present invention relates to an internal lubricating system of a swash plate type refrigerant compressor, and more particularly, to a swash plate type compressor having an internal refrigerant and lubricant separating system capable of providing a separation between an internal lubricating system from an internal refrigerant circuit in such a manner that an oil suspended refrigerant gas flowing out of a swash plate chamber is returned to the refrigerant circulating circuit after the lubricating oil component is separated and removed therefrom.

2. Description of the Related Art

A typical conventional swash plate type compressor is shown in FIG. 13, and has a front cylinder block 1 and a rear cylinder block 2 combined to form an axially extended cylinder block assembly having a horizontal axis thereof. The compressor also has a front valve plate 3 attached to the open end of the front cylinder block 1, a rear valve plate 4 attached to the open end of the rear cylinder block 2, a front housing 5 covering the front end of the cylinder block assembly, and a rear housing 6 covering the rear end of the cylinder block assembly. A swash plate chamber 7 is formed in the cylinder blocks 1 and 2 of the cylinder block assembly, and an oil sump 8 is provided in a bottom part of the cylinder block assembly, and located under the swash plate chamber 7. An axial drive shaft 9 connectable to a drive source ( not shown ) is rotatably supported by the cylinder blocks assembly via front and rear radial bearings 22 and the rotating axis of the drive shaft 9 is arranged in registration with the horizontal axis of the cylinder block assembly. A swash plate 10 is fixedly mounted on the drive shaft 9 in the swash plate chamber 7, to be rotated with the drive shaft 9. A plurality of cylinder bores 12 are formed in the cylinder blocks 1 and 2, and arranged around the rotating axis of the drive shaft 9, and a double-headed piston 13 is fitted in each cylinder bore 12 for sliding reciprocation. Each double-headed piston 13 is engaged with the swash plate 10 by ball and shoe elements 14. When the swash plate 10 is rotated about the horizontal rotating axis of the drive shaft 9 to thereby implement a wobbling motion, the pistons 13 are reciprocated in the respective cylinder bores 12 for a suction and compression of a refrigerant gas, and a discharge of the compressed refrigerant gas. The refrigerant compressor of FIG. 13 employs a forced lubrication system, for example, a forced lubrication system disclosed in Japanese Unexamined (Kokai) Utility Model Publication No. 59-107074, including an oil pump 15 provided in the rear housing 6 and driven by the drive shaft 9 to lubricate front and rear thrust bearings 11 provided between the cylinder blocks 1 and 2 and a boss of the swash plate 10, and the ball and shoe elements 14. The forced lubrication system lifts lubricating oil "A" from the oil sump 8 into a pump chamber 19, by the oil pump 15, to feed the oil "A" through a lubricating hole 20 and radial branch passageways of the drive shaft 9 to the front and rear thrust bearings 11.

Another conventional lubricating system circulates a mist of lubricating oil A through a refrigerant circulating circuit which runs through front and rear suction chambers 21 of the front and rear housings 5 and 6, the cylinder bores 12 of the cylinder block assembly. and front and rear discharge chambers 23 of the front and rear housings 5 and 6, and through the swash plate chamber 7 to lubricate the thrust bearings 11 and the ball and shoe elements 14.

In the above-mentioned conventional swash plate type refrigerant compressor, although a pressure prevailing in the swash plate chamber 7 is preferably equal to that in the refrigerant suction side, the pressure in the swash plate chamber 7 increases beyond the pressure in the suction side during the operation of the compressor, due to a blowby gas leaking from the cylinder bores 12 into the swash plate chamber 7 when compressing the refrigerant gas by the pistons 13. The swash plate chamber 7 is fluidly communicated with the suction chambers 21 by a gap in radial bearings 22, but the gap is insufficient to equalize the pressures levels of the swash plate chamber 7 and the suction chambers 21. Accordingly, a pressure equalizing hole, not shown, is usually formed between the swash plate chamber 7 and the suction side of the refrigerant circulating circuit, i.e., the suction chambers 21 and the suction passageway.

Nevertheless, in the forced lubricating system, a pressure difference between the swash plate chamber 7 and the suction side increases when the drive shaft 9 is running at a high rotating speed, for example, at 5000 rpm, and a thick mist of lubricating oil "A" flows, together with the refrigerant gas, from the swash plate chamber 7 into the refrigerant circulating circuit through short passageways connecting the swash plate chamber 7 and the refrigerant suction side. Therefore, the quantity of the lubricating oil "A" flowing out from the swash plate chamber 7 is more than that of the lubricating oil "A" flowing into the swash plate chamber 7, and accordingly, the quantity of the lubricating oil "A" reserved in the swash plate chamber 7 gradually decreases to an insufficient quantity, entailing an insufficient lubrication of the elements to be lubricated, causing the seizure of the ball and shoe elements 14, and causing a rapid abrasion of the elements. Moreover, the lubricating oil "A" discharged together with the refrigerant gas into the outer refrigerating circuit accumulates in an evaporator of the refrigerating circuit to reduce the cooling efficiency of the refrigerating circuit.

On the other hand, the lubricating system which lubricates the refrigerant circulating circuit and the swash plate chamber 7 by the mist of lubricating oil "A" separates the lubricating oil "A" from the refrigerant gas discharged into the discharge chambers 23 by an appropriate filter device, and returns the separated lubricating oil "A" to the refrigerant suction side of the compressor to prevent the lubricating oil "A" from flowing into the outer cooling circuit. Nevertheless, the filter device is unable to completely separate the lubricating oil from the refrigerant gas, and therefore, lubricating oil accumulates in the evaporator and the like of the outer refrigerating circuit to thereby reduce the cooling efficiency of the refrigerating circuit.

SUMMARY OF THE INVENTION

Therefore, an object of the present invention is to obviate the defects encountered by the conventional swash plate type refrigerant compressor.

Another object of the present invention is to provide a swash plate type compressor with an internal refrigerant and lubricant separating system capable of providing a separation between an internal lubricating system from an internal refrigerant circuit in such a manner that an oil suspended refrigerant gas flowing out of a swash plate chamber is returned to the refrigerant circuit after the lubricant oil is separated and removed therefrom.

In accordance with the present invention, there is provided a swash plate type compressor having an internal refrigerant and lubricant separating system which comprises:

a compressor casing defining a plurality of axially extended cylinder bores circumferentially arranged around a predetermined horizontal axis thereof, and a refrigerant circulating circuit having a refrigerant suction side and a refrigerant discharge side;

a swash plate chamber provided in an axially central position of the compressor casing;

an oil sump provided in the compressor casing at a lower position with respect to the predetermined horizontal axis of the compressor casing, the oil sump being arranged under and communicated with the swash plate chamber for reserving a given amount of lubricant oil;

pistons fitted respectively in the cylinder bores for sliding reciprocation to compress a refrigerant gas brought from the refrigerant suction side of the refrigerant circulating circuit and to discharge the compressed gas toward the refrigerant discharge side of the refrigerant circulating circuit;

a drive shaft rotatably supported by the compressor casing via bearing means, and having a rotating axis thereof in registration with the predetermined horizontal axis of the compressor casing;

a swash plate mounted on the drive shaft in the swash plate chamber to be rotatable with the drive shaft to thereby reciprocate the pistons for suction and compression;

a refrigerant and lubricant separating chamber provided in the compressor casing and having the lowest bottom level thereof located at a level higher than that of a surface of the given amount lubricant oil reserved in the oil sump or the swash plate chamber;

a communication passageway having a reduced cross-sectional area and provided with first and second openings, the first port opening toward the swash plate chamber and the second port opening toward the refrigerant and lubricant separating chamber to thereby provide a fluid communication between the swash plate chamber and the refrigerant and lubricant separating chamber;

a refrigerant evacuation passageway having a reduced cross-sectional area and extending from the refrigerant and lubricant separating chamber to the refrigerant suction side of the refrigerant circulating circuit, the refrigerant evacuation passageway having a first port opening toward the refrigerant and lubricant separating chamber and a second port opening toward the refrigerant suction side of the refrigerant circulating circuit; and, an arrangement in which the first opening of the refrigerant evacuation passageway is located at a position higher than the first opening of the communication passageway.

In the swash plate type compressor of the present invention, a refrigerant gas and a mist of lubricating oil suspended in the refrigerant gas flow from the swash plate chamber through the communication passageway into the refrigerant and lubricant separating chamber when the pressure in the swash plate chamber is increased due to a blow-by gas leaking from the cylinder bores into the swash plate chamber while the drive shaft is rotated at a high speed. Since the speed of the flow of the refrigerant gas is reduced when the refrigerant gas flows out of the communication passageway having the reduced cross-sectional area into the refrigerant and lubricant separating chamber, the lubricating oil component suspended in the refrigerant gas is separated from the refrigerant gas. The refrigerant gas from which the lubricating oil is separated then flows from the refrigerant and lubricant separating chamber through the refrigerant evacuation passageway and the refrigerant suction side of the refrigerant gas circulating circuit into the swash plate chamber, while the lubricating oil separated from the refrigerant gas returns through the communication passageway into the swash plate chamber.

DESCRIPTION OF THE DRAWINGS

The above and other objects, features and advantages of the present invention will be made apparent from the ensuing description of the embodiments in conjunction with the accompanying drawings wherein.

DESCRIPTION OF THE PREFERRED EMBODIMENTS

Figure 13:
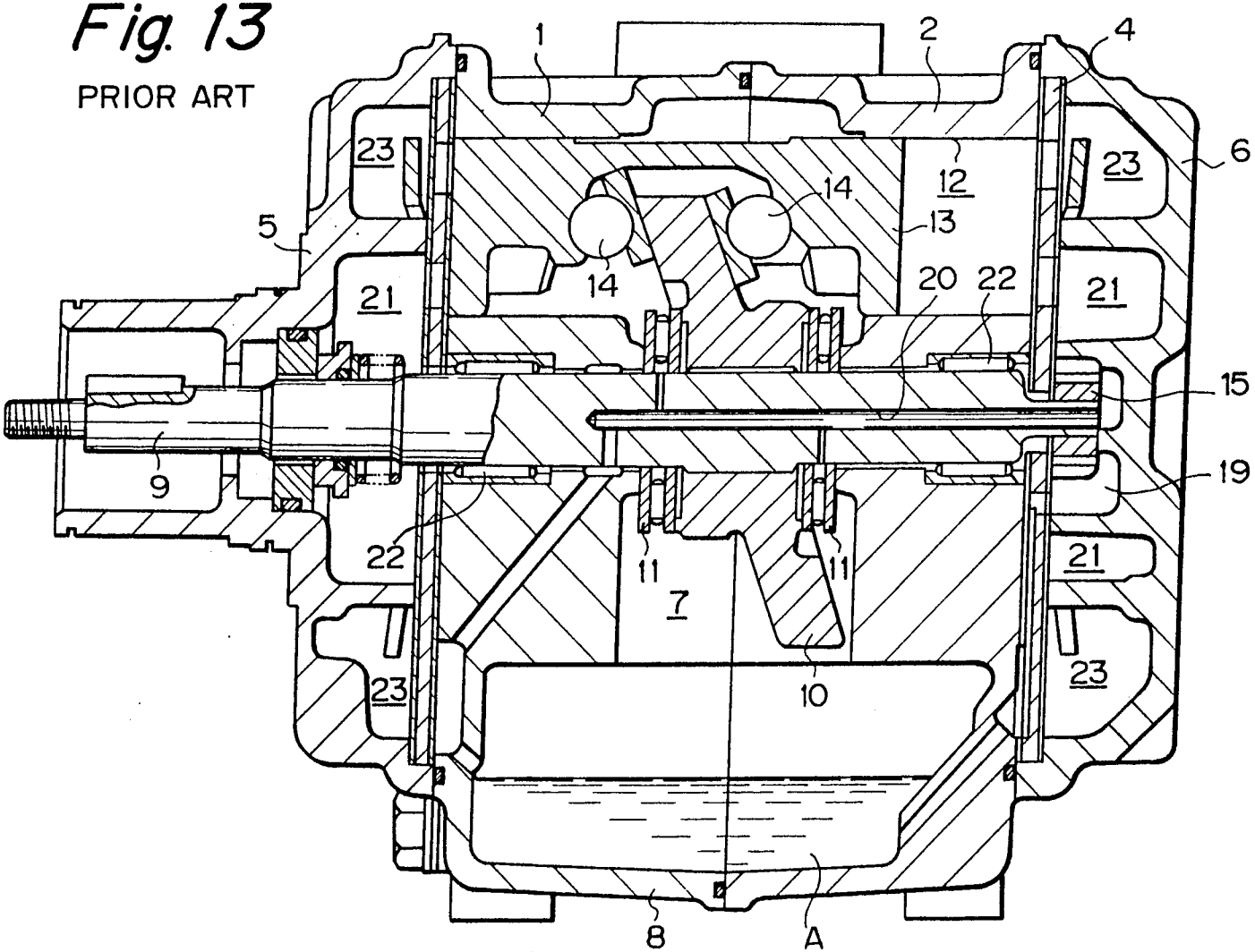
Fig. 13 PRIOR ART
FIG. 13 is a cross-sectional view of a swash plate type compressor with an internal lubricating system according to a typical prior art.

Throughout the description of the embodiments, elements and parts of the swash plate type compressor having like or similar functions to those of the compressor of the prior art shown in FIG. 13 are shown by the same reference numerals as in FIG. 13, and a detailed description of such elements and parts will be omitted.

Figure 1:
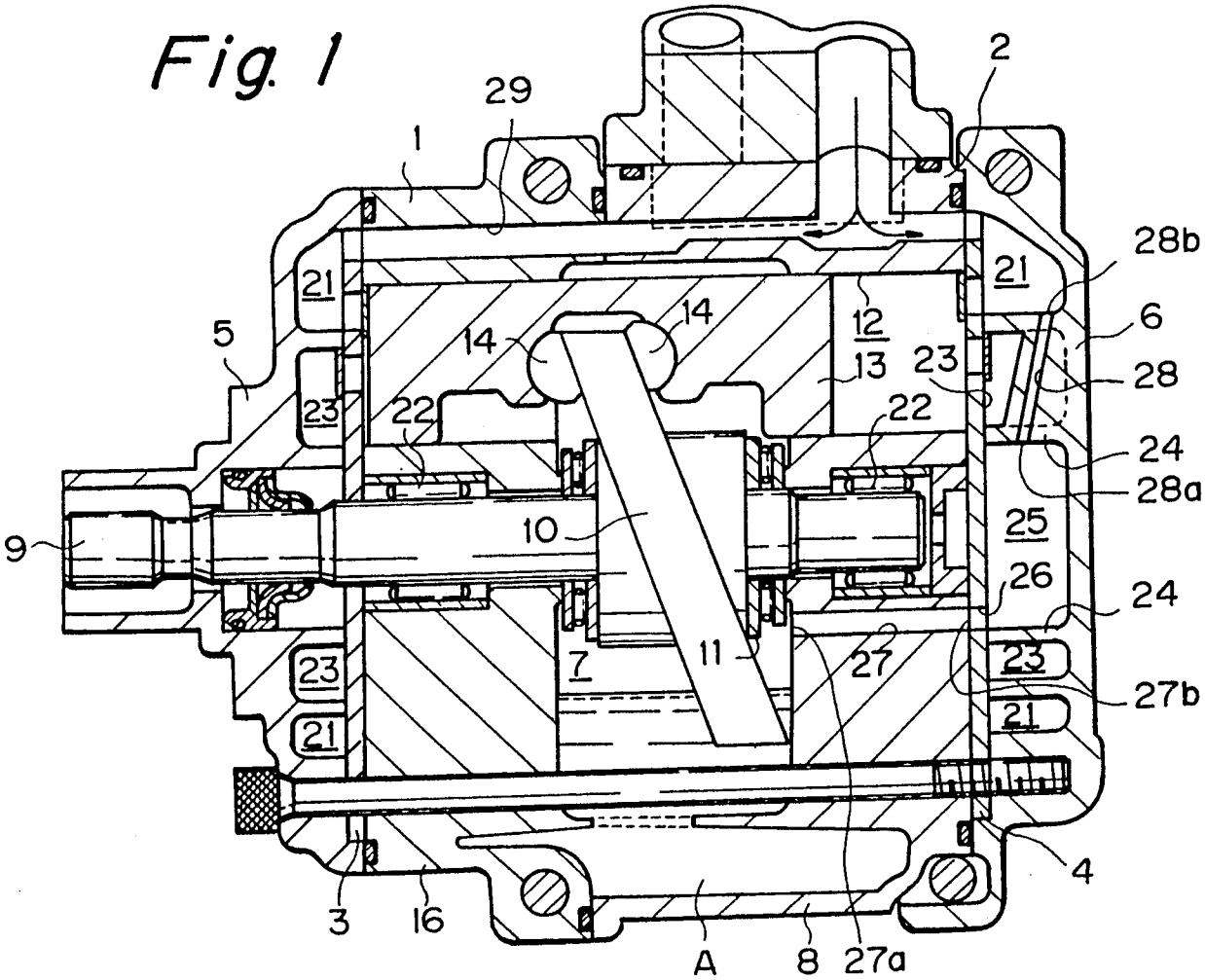
FIG. 1 is a longitudinal cross-sectional view of a swash plate type refrigerant compressor with an isolated internal lubricating system according to an embodiment of the present invention.
Figure 2:
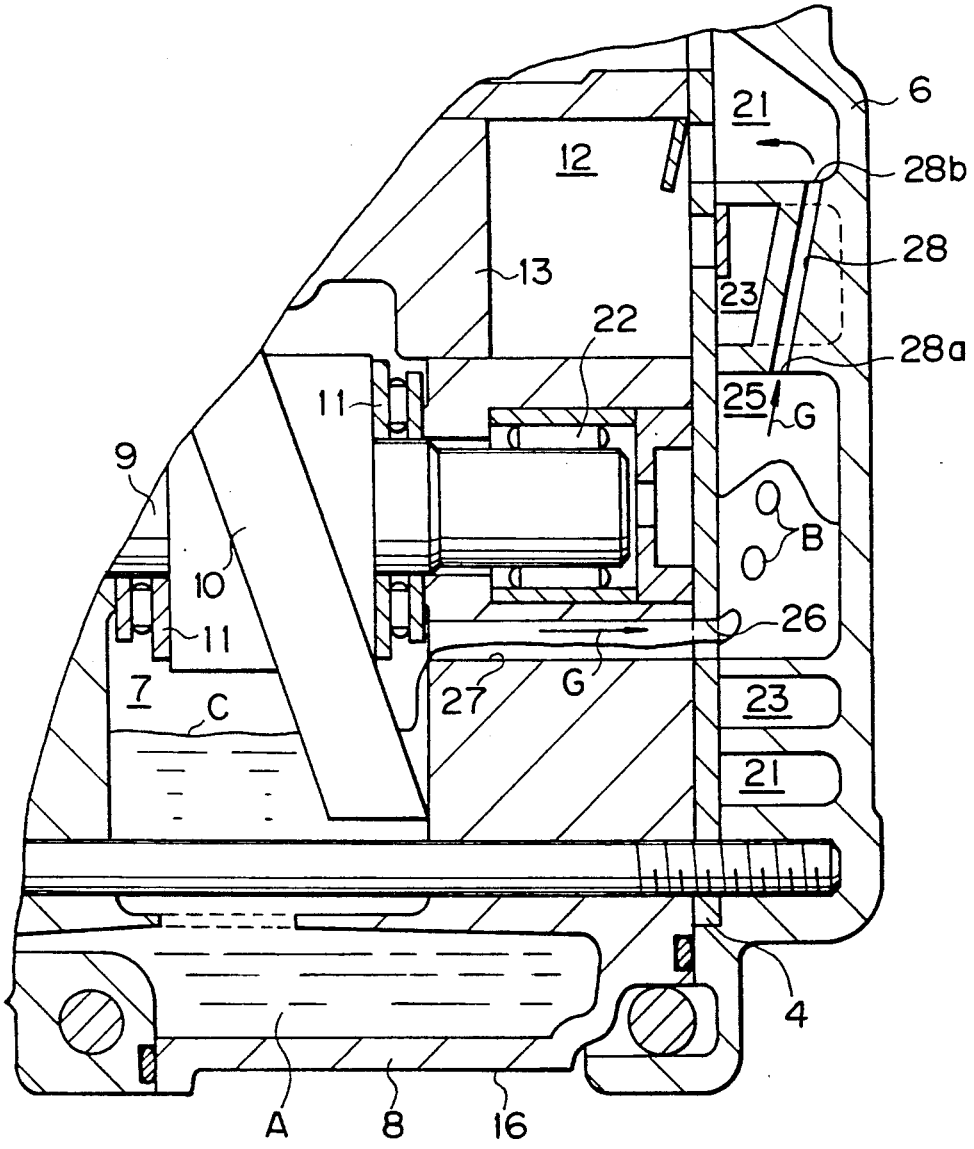
FIG. 2 is a partial cross-sectional view of an essential portion of the swash plate type compressor of FIG. 1.

Referring to FIGS. 1 and 2, illustrating a swash plate type compressor according to a first embodiment of the present invention, the horizontally arranged compressor has a body or casing 16 provided with a front cylinder block 1, a rear cylinder block 2, a front valve plate 3, and a rear valve plate 4. The swash plate type compressor of the present embodiment is different from the compressor of FIG. 13 in that front and rear thrust bearings 11 and radial bearings 22 are lubricated by a lubricating oil "A", without using an oil pump, by directly splashing the lubricating oil "A" with a swash plate 10, and that an arrangement of the front and rear suction chambers 21 and front and rear discharge chambers 23 in a front and a rear housing 5 and 6, respectively with respect to a radial direction, is the reverse of that of the suction chambers and the discharge chambers of the known swash plate type compressor. A lubricating oil "A" is reserved in the bottom of a swash plate chamber 7 and an oil sump 8 so that an outer part of a swash plate 10 is partially immersed in the lubricating oil "A". A refrigerant and lubricant separating chamber 25 is formed near the rear end of an axial drive shaft 9 and in the central portion of the rear housing 6. The refrigerant and lubricant separating chamber 25 is enclosed by a partition wall 24 and isolated from the suction chamber 21 and the discharge chamber 23 of the rear housing 6. The front and rear suction chambers 21 are connected to a suction passageway 29 formed in the respective upper portions of the cylinder blocks 1 and 2, to draw a refrigerant gas "G" from an outer refrigerating circuit. A through-hole 26 is formed in a rear valve plate 4 at a position adjacent to the bottom of the refrigerant and lubricant separating chamber 25. A linear passageway 27 having a reduced sectional area is formed in the rear end wall of the rear cylinder block 2 to provide a fluid communication between the swash plate chamber 7 and the refrigerant and lubricant separating chamber 25 via the through-hole 26 and the swash plate chamber 7. Therefore, the passageway 27 has a first port **27*a* opening toward the swash plate chamber 7 and a second port 27*b* opening toward the refrigerant and lubricant separating chamber 25. A refrigerant gas evacuation passageway 28 having a first port 28*a* and a second port 28*b* is formed in the rear housing 6 at a position corresponding to the upper end of the refrigerant and lubricant separating chamber 25, to fluidly connect the refrigerant and lubricant separating chamber 25 and the suction chamber 21 of the internal refrigerant circulating circuit. The first port 27*a* of the passageway 27 opening into the swash plate chamber 7 is set at a position higher than the level of the surface C of the lubricating oil "A" contained in the swash plate chamber 7, and the first port 28*a* of the gas evacuation passageway 28 opening into the suction chamber 21 is set at a position higher than that of the port 27*a* of the passageway 27 on the side of the swash plate chamber 7**.

The description of the operation and effects of the present embodiment will be described hereinafter.

When driven by the drive shaft 9 for wobbling rotation, the swash plate 10 splashes the lubricating oil "A" contained in the swash plate chamber 7 to lubricate the thrust bearings 11, the ball and shoe elements 14 and the radial bearings 22. As the swash plate 10 is driven for wobbling rotation, the pistons 13 are reciprocated for compression of the refrigerant gas. When the pressure level in the swash plate chamber 7 is gradually increased beyond the pressure level in the suction chambers 21, due to a high pressure blow-by gas leaking from the cylinder bores 12 into the swash plate chamber 7, the refrigerant gas G suspending a thick mist of lubricant oil "A" therein flows from the swash plate chamber 7 through the linear passageway 27 into the refrigerant and lubricant separating chamber 25. Since the velocity of the refrigerant gas G is lowered when the refrigerant gas G is discharged from the passageway 27 having a reduced sectional area into the refrigerant and lubricant separating chamber having a substantial volume therein, the lubricating oil "A" suspended in the refrigerant gas G in a mist condition is separated from the refrigerant gas G, and the oil removed refrigerant gas G due to the separation of the lubricating oil "A" flows through the gas evacuation passageway 28 into the suction chamber 21.

On the other hand, the lubricating oil "A" separated from the refrigerant gas G stays in the refrigerant and lubricant separating chamber 25 without flowing into the gas evacuation passageway 28, and then gradually returns through the passageway 27 into the swash plate chamber 7. If a comparatively large quantity of the lubricating oil "A" collects in the refrigerant and lubricant separating chamber 25 as shown in FIG. 2, the refrigerant gas G flows from the swash plate chamber 7 through the passage way 27 into the refrigerant and lubricant separating chamber 25 and flows upward in bubbles B through the lubricating oil "A" collected in the refrigerant and lubricant separating chamber 25. Accordingly, the lubricating oil "A" contained in the bubbles B in a mist condition is arrested by the lubricating oil "A" collected in the refrigerant and lubricant separating chamber 25. Thus, the swash plate type compressor in the first embodiment is capable of separating the mist of lubricating oil "A" suspended in the refrigerant gas G within the refrigerant and lubricant separating chamber 25 even when the pressure in the swash plate chamber 7 is increased by the high-speed rotation of the drive shaft 9. The swash plate type compressor is also capable of returning the lubricating oil "A" separated from the refrigerant gas G into the swash plate chamber 7 while permitting the refrigerant gas G to flow into the suction chamber 21. As a result, an insufficient lubrication of the movable elements and parts of the compressor and reduction in the cooling efficiency can be prevented.

Figure 3:
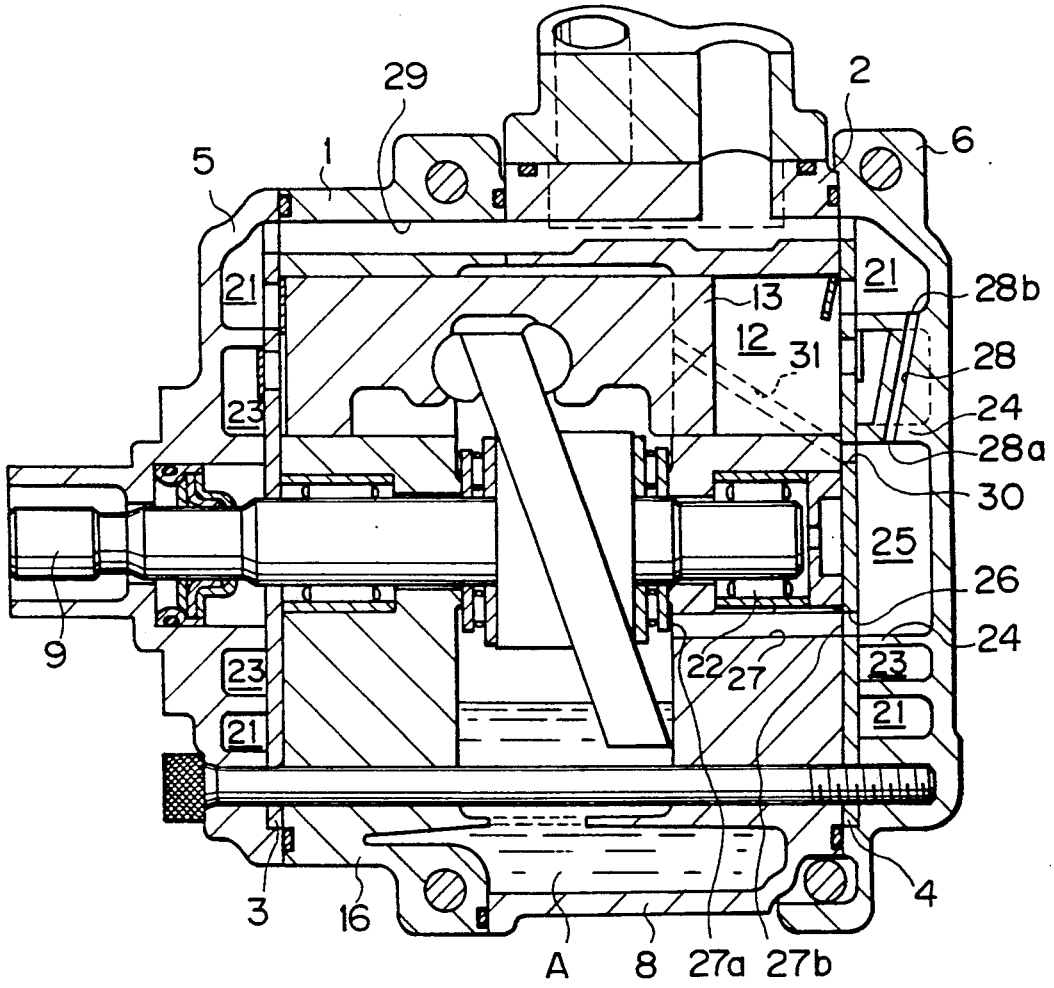
FIG. 3 is a longitudinal cross-sectional view of a swash plate type compressor with an isolated internal lubricating system according to a second embodiment of the present invention.

A swash plate type compressor according to a second embodiment of the present invention will be described hereinafter with reference to FIG. 3. In this embodiment a through-hole 30 is additionally formed in a rear valve plate 4 at a position corresponding to the upper end of a refrigerant and lubricant separating chamber 25, and an oblique pressure equalizing passageway 31 inclined toward the front is formed in the rear end wall of a rear cylinder block 2 to connect the through-hole 30 to the upper portion of a swash plate chamber 7. The upper end of the pressure equalizing hole 31 opens into the swash plate chamber 7 on a level lower than that on which the upper end of a gas evacuation passageway 28 opens into a suction chamber 21.

Accordingly, in addition to having operation and effects which are the same as those of the first embodiment of FIGS. 1 and 2, the second embodiment is capable of storing the lubricating oil "A" in the refrigerant and lubricant separating chamber 25 until the surface of the lubricating oil "A" collected in the refrigerant and lubricant separating chamber 25 reaches a level coinciding with the open end of the pressure equalizing hole 31, and allows the lubricating oil "A" collected in the gas-oil separating chamber 25 to flow through the pressure equalizing hole 31 into the swash plate chamber 7. Therefore, the lubricating oil "A" will not flow into the suction chamber 21 even if the lubricating oil "A" is collected also in the gas evacuation passageway 28, due to the pressure equalization between the swash plate chamber 7 and the suction chamber 21, via the pressure equalizing hole 31 and the gas evacuation passageway 28.

Figure 4:
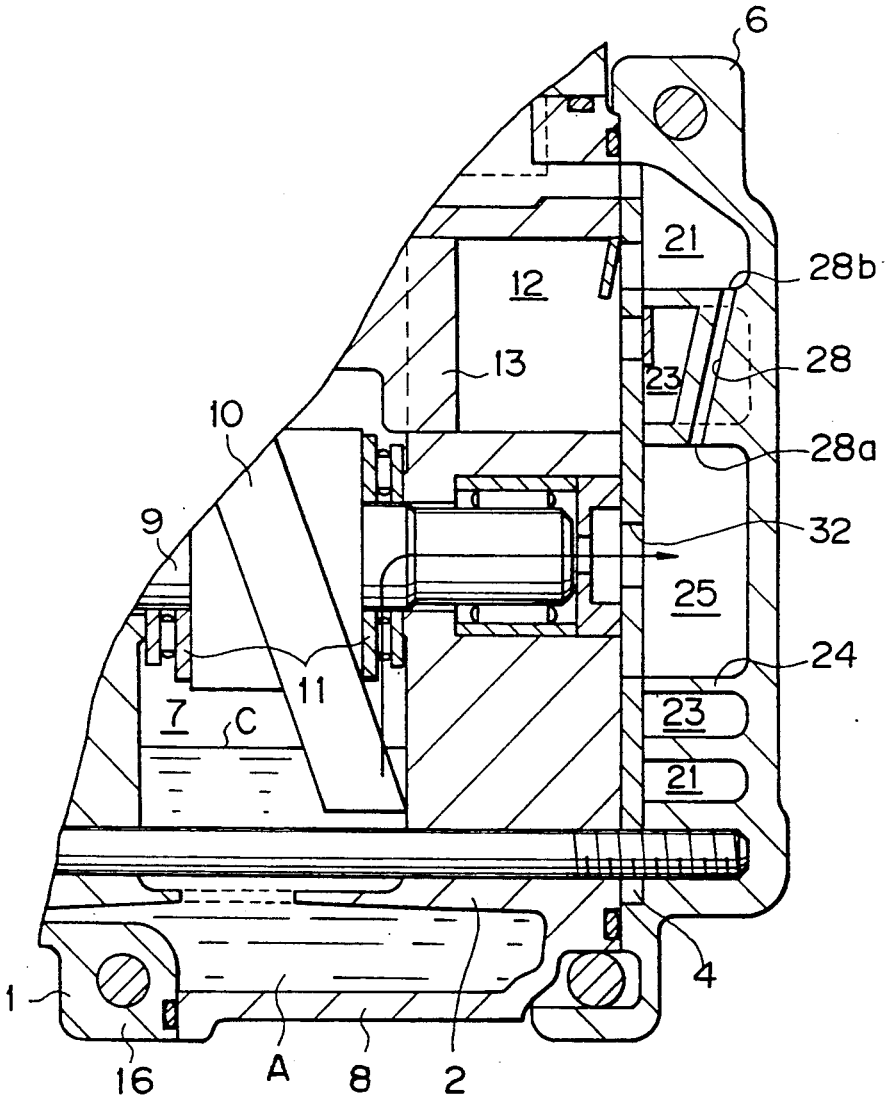
FIG. 4 is a partial cross-sectional view of an essential portion of a swash plate type compressor with an isolated internal lubricating system according to a third embodiment of the present invention.

A swash plate type compressor according to a third embodiment of the present invention will be described hereinafter with reference to FIG. 4. In the third embodiment, a bore 32 is formed in a rear valve plate 4. The bore 32 and gaps in thrust bearings 11 and radial bearings 22 form a passageway 33 instead of the aforementioned communication passageway 27 of the first and second embodiment. Thus, the construction of the third embodiment is simplified compared with the first and second embodiment.

Figure 5:
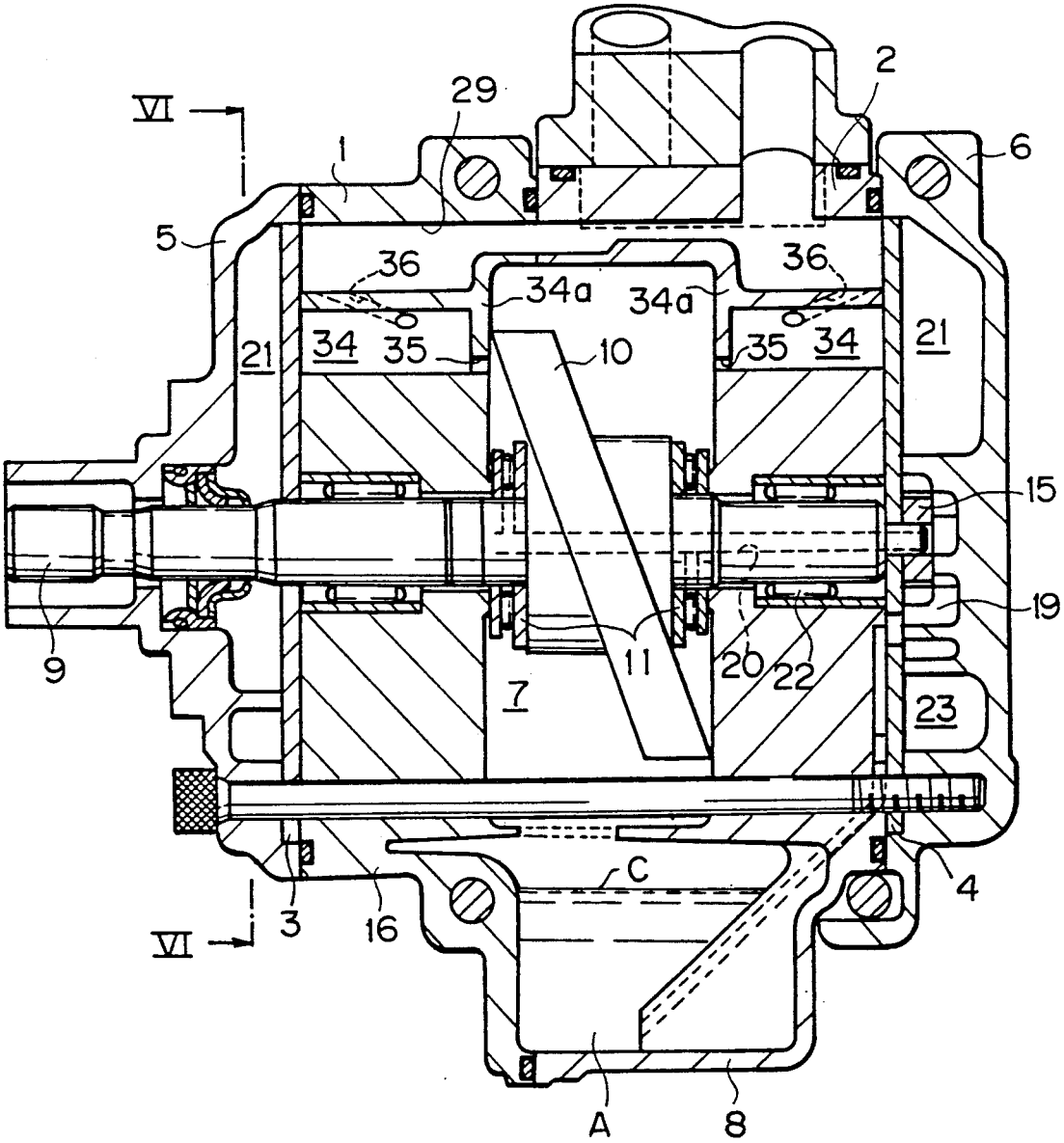
FIG. 5 is a longitudinal cross-sectional view, taken along the line V—V of FIG. 6, of a swash plate type compressor with an isolated internal lubricating system according to a fourth embodiment of the present invention.
Figure 6:
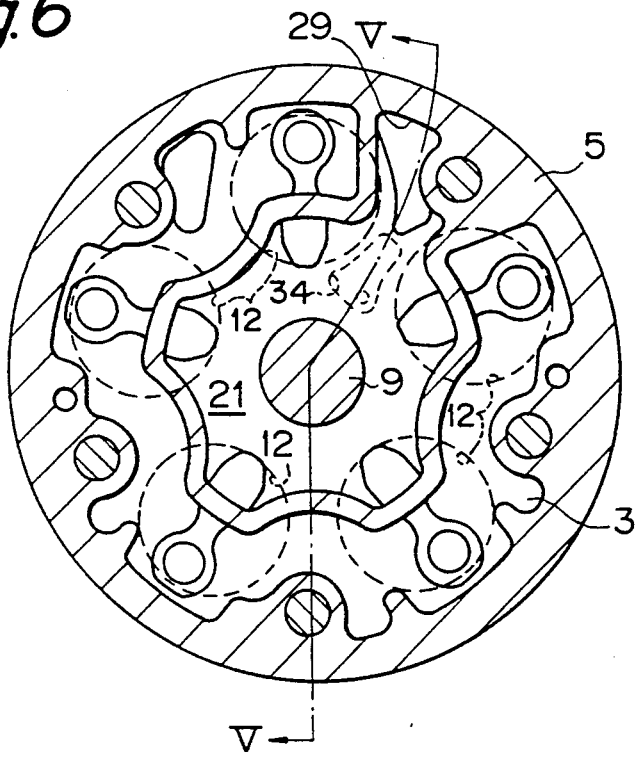
FIG. 6 is a cross-sectional view taken along the line VI—VI in FIG. 5.

A swash plate type compressor according to a fourth embodiment of the present invention will be described with reference to FIGS. 5 to 7.

The swash plate type compressor of the fourth embodiment is provided with an oil pump 15 connected to and driven by a drive shaft 9. The oil pump 15 is arranged in a pump chamber 19 formed in a rear housing 6 of the compressor. An oil sump 8 reserving a given amount of lubricating oil "A" is provided in the lowermost portion of the cylinder block assembly formed by front and rear cylinder blocks 1 and 2. A pair of refrigerant and lubricant separating chambers 34 are formed in the upper portions of the cylinder blocks 1 and 2 with respect to the horizontal axis of the cylinder block assembly, and circumferentially arranged at a position between two adjacent cylinder bores 12 as shown in FIG. 6, and axially arranged before and after a swash plate chamber 7, respectively. A passageway 35 having a reduced sectional area is formed in the inner wall **34*a* of each refrigerant and lubricant separating chamber 34 at the lower end of the wall 34*a* to provide a fluid communication between the refrigerant and lubricant separating chamber 34 and the swash plate chamber 7. A gas evacuation passageway 36 is formed in the upper wall of each refrigerant and lubricant separating chamber 34 so that the chamber 34 is fluidly communicated with a refrigerant suction passage 29 of the internal refrigerant circulating circuit of the compressor. Each gas evacuation passageway 36** extends obliquely to secure a sufficient length thereof.

Figure 7:
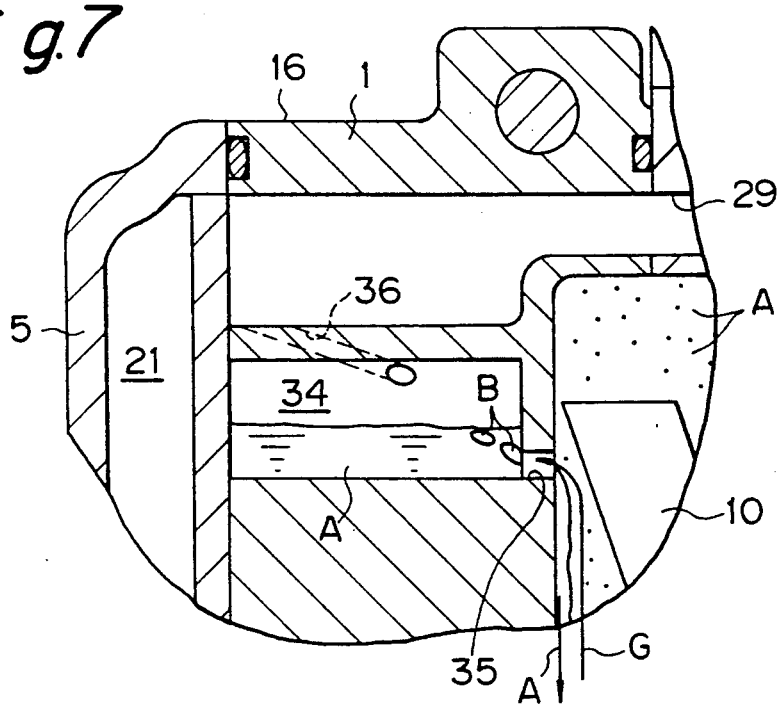
FIG. 7 is a cross-sectional view of an essential portion of the swash plate type compressor of FIG. 5.

In operation, a lubricant-suspended refrigerant gas G flows from the swash plate chamber 7 through the passageways 35 into the refrigerant and lubricant separating chambers 34, as best shown in FIG. 7, and the mist of lubricating oil "A" is separated from the refrigerant gas G in the same manner as in the first embodiment of FIGS. 1 and 2. The refrigerant gas G, which is free from the lubricating oil "A", flows through the gas evacuation passageways 36 into the suction chamber 21, and the lubricating oil "A" separated from the refrigerant gas G collects in the gas-oil separating chamber 34 without flowing through the gas evacuation passages 36. Then, the lubricating oil "A" returns through the passageways 35 into the swash plate chamber 7. If a comparatively large quantity of the lubricating oil "A" has collected in the refrigerant and lubricant separating chamber 34, the refrigerant gas G flowing from the swash plate chamber 7 through the passageways 35 into the refrigerant and lubricant separating chambers 34 flows upward in bubbles B through the collected lubricating oil "A", and the lubricating oil "A" contained in a mist condition in the bubbles B is arrested by the lubricating oil "A" collected in the refrigerant and lubricant separating chamber 34.

Since the swash plate type compressor of the fourth embodiment is provided with the refrigerant and lubricant separating chambers 34 in the upper portions of the cylinder blocks 1 and 2 respectively, the drive shaft 9 and the thrust and radial bearings 11 and 22 are satisfactorily lubricated by the lubricating oil "A" returning from the refrigerant and lubricant separating chamber 34 through the passageways 35 into the swash plate chamber 7.

Figure 8:
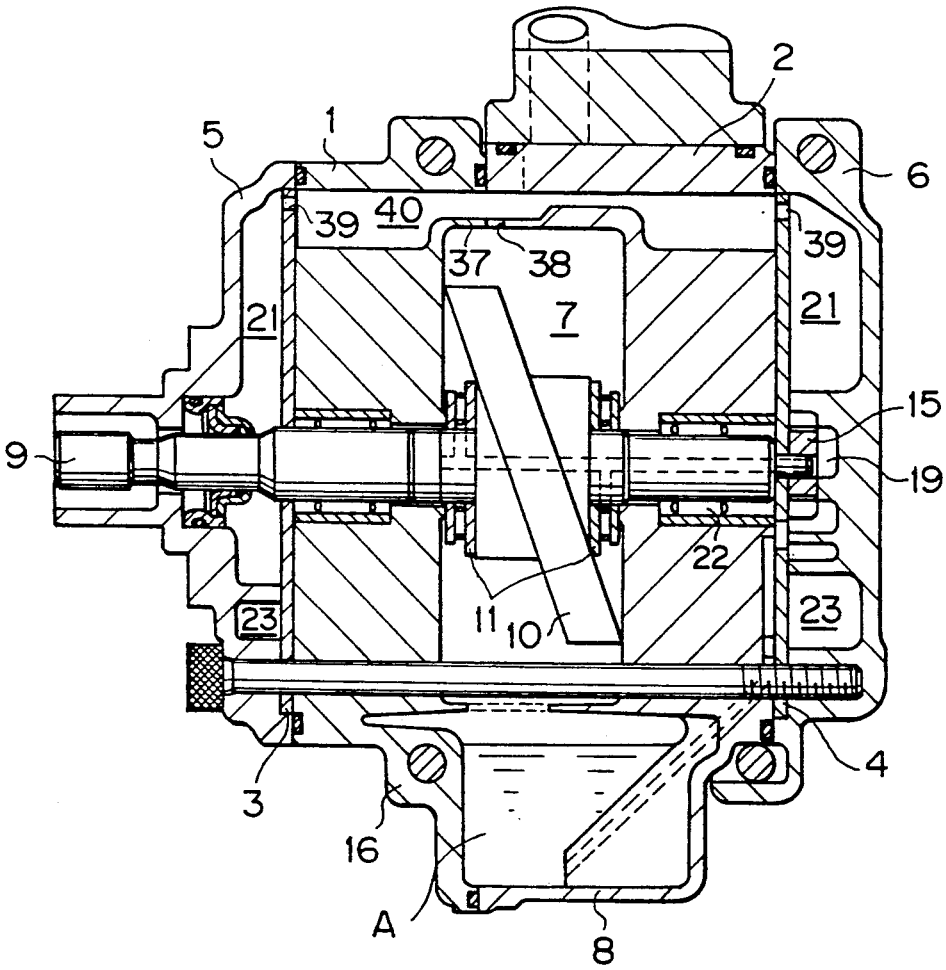
FIG. 8 is a cross-sectional view of a swash plate type compressor with an isolated internal lubricating system according to a fifth embodiment of the present invention.
Figure 9:
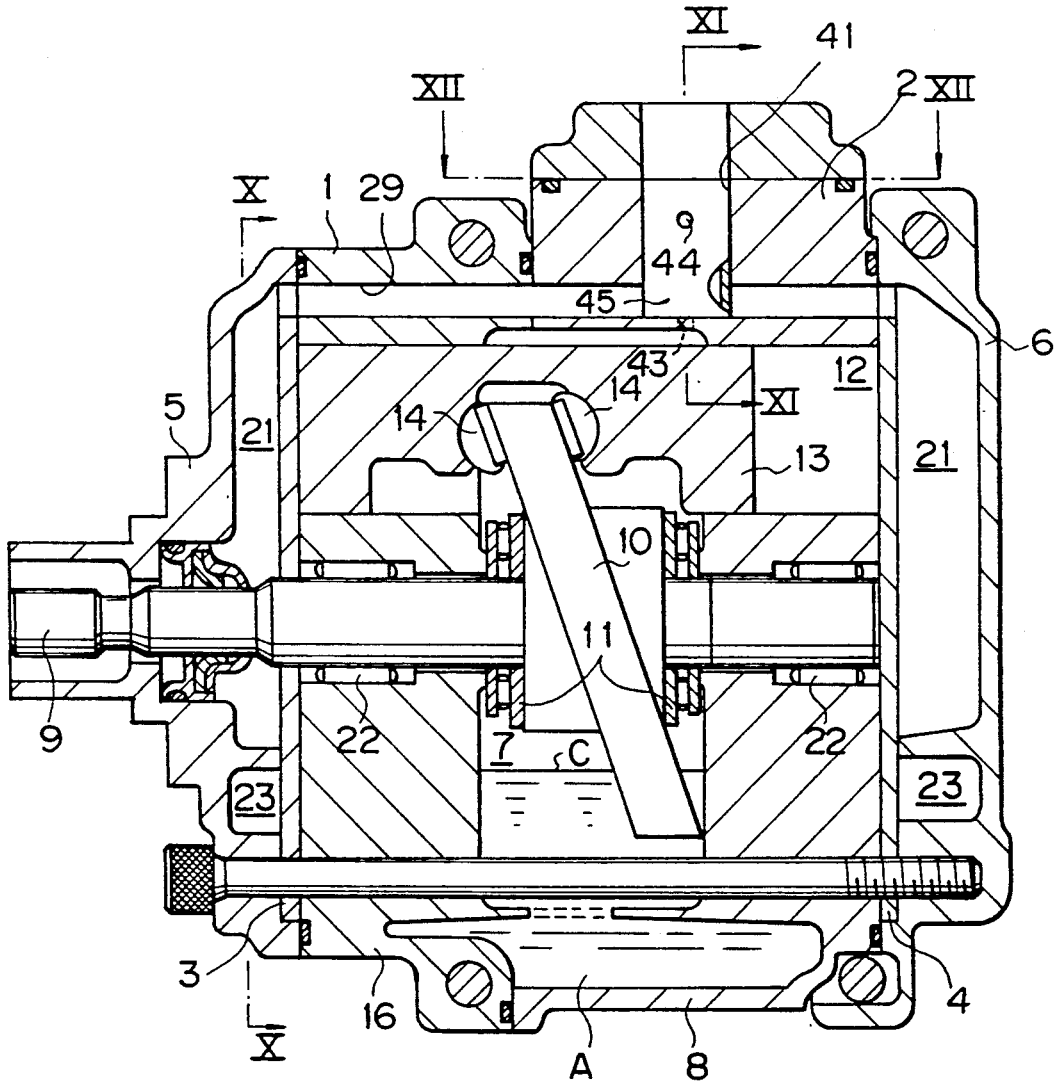
FIG. 9 is a cross-sectional view of a swash plate type compressor with an isolated internal lubricating system according to a sixth embodiment of the present invention.
Figure 10:
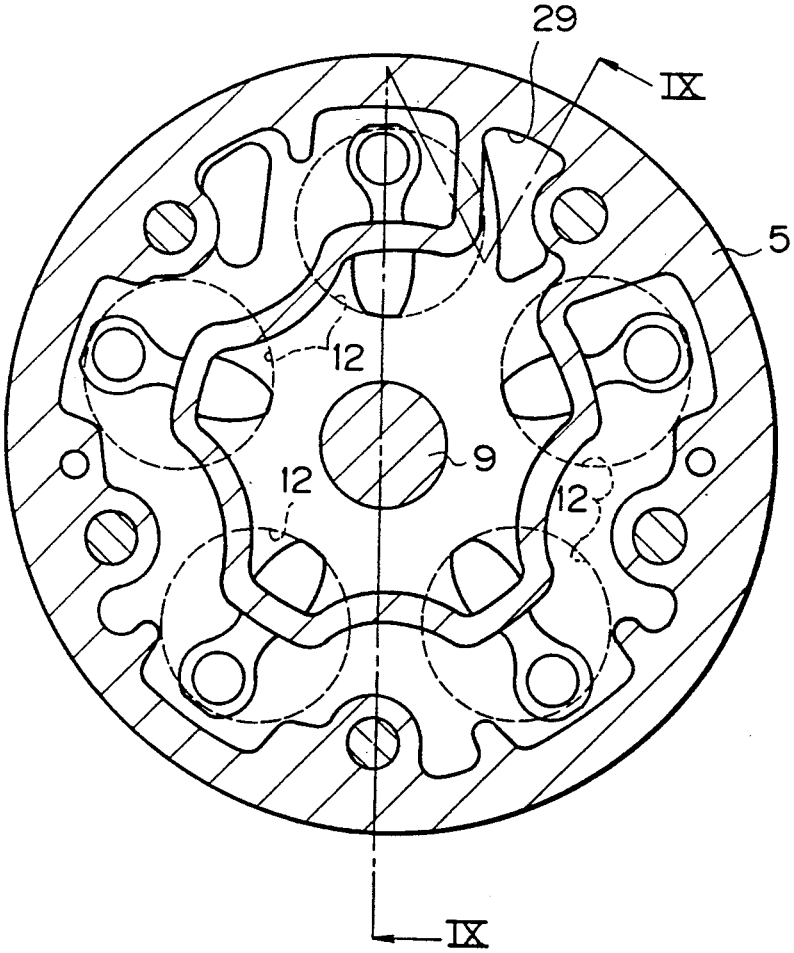
FIG. 10 is a cross-sectional view taken along the line X—X in FIG. 9.
Figure 12:
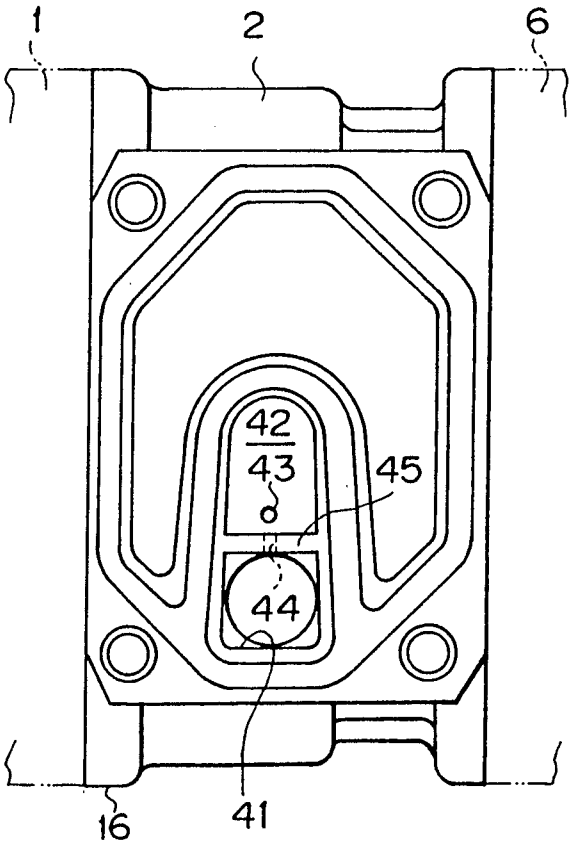
FIG. 12 is a cross-sectional view taken along the line XII—XII in FIG. 9.

A swash plate type compressor according to a fifth embodiment of the present invention will be described hereinafter with reference to FIG. 8.

In the fifth embodiment, a refrigerant and lubricant separating chamber 40 is formed in the upper portions of cylinder blocks 1 and 2 over a swash plate chamber 7, a passageway 38 is formed in a partition wall 37 to connect the refrigerant and lubricant separating chamber 40 to the swash plate chamber 7, and gas evacuation passageways 39 are formed in the upper portions of a front valve plate 3 and a rear valve plate 4, respectively, to connect the refrigerant and lubricant separating chamber 40 to a suction chamber 21. Thus, the refrigerant and lubricant separating chamber 40 of the fifth embodiment has a greater volume than the refrigerant and lubricant separating chambers 34 of the fourth embodiment, and thus has a higher capacity than the latter to separate the lubricating oil "A" from the refrigerant gas G.

A swash plate type compressor according to a sixth embodiment of the present invention will be described hereinafter with reference to FIG. 9 to 12.

Figure 11:
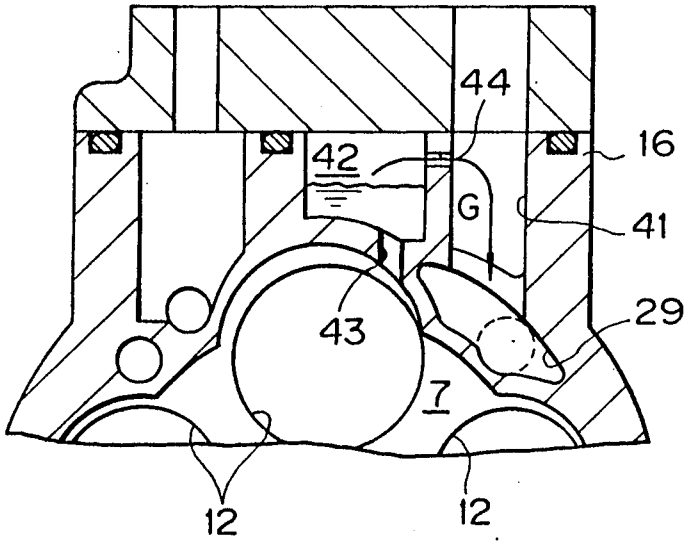
FIG. 11 is a cross-sectional view taken along the line XI—XI in FIG. 9.

In the present embodiment, a gas inlet hole 41 for introducing a refrigerant gas G returned from an outer refrigerating circuit, not shown, into a suction passageway 29 formed in the upper portions of cylinder blocks 1 and 2 is formed in the upper portion of the rear cylinder block 2, and a refrigerant and lubricant separating chamber 42 in the form of a vertical recess as best shown in FIG. 11, is formed adjacent to and on one side of the gas inlet hole 41. A passageway 43 is formed through the bottom wall of the refrigerant and lubricant separating chamber 42 to connect the separating chamber 42 to a swash plate chamber 7, and a gas evacuation passageway 44 is formed in the upper portion of a partition wall 45 to connect the refrigerant and lubricant separating chamber 42 to the gas inlet hole 41. Lubricating oil "A" separated from the refrigerant gas G and collected in the refrigerant and lubricant separating chamber 42 drips through the passageway 43 into the swash plate chamber 7, while the refrigerant gas G, which is free from the lubricating oil component, flows through the gas evacuation passageway 44 into the suction passageway 29.

As understood from the foregoing description, according to the present invention, the lubricating oil suspended in a mist condition in the refrigerant gas within the swash plate chamber of the swash plate type compressor can be separated from the refrigerant gas in the specific refrigerant and lubricant separating chamber, and the separated lubricating oil returned to the swash plate chamber and the oil sump. The refrigerant gas is then returned to the suction passageway after the separation of the lubricating oil. Therefore, an insufficient lubrication of the movable elements and parts of the compressor can be prevented, and a reduction in the cooling efficiency of the cooling circuit is avoided.

The present invention is not limited in practical application to the foregoing first through sixth embodiments. For example, the passageway 27 in the first and second embodiments may be inclined to the front. Therefore, it should be understood that many modifications and variations of the present invention will occur to a person skilled in the art without departing from the spirit and scope of the present invention.

We claim:

1. A swash plate type compressor having an internal refrigerant and lubricant separating system comprising:

a compressor casing defining a plurality of axially extended cylinder bores circumferentially arranged around a predetermined horizontal axis thereof, and a refrigerant circulating circuit independent of said compressor casing having a refrigerant suction side and a refrigerant discharge side;

a swash plate chamber provided in an axially central position of said compressor casing;

an oil sump provided in said compressor casing at a lower position with respect to said predetermined horizontal axis of said compressor casing, said oil sump being arranged under and communicated with said swash plate chamber for reserving a given amount of lubricant oil;

pistons fitted respectively in said cylinder bores for sliding reciprocation to compress a refrigerant gas brought from the refrigerant suction side of said refrigerant circulating circuit and to discharge the compressed gas toward the refrigerant discharge side of said refrigerant circulating circuit;

a drive shaft rotatably supported by said compressor casing via bearing means, and having a rotating axis thereof in registration with said predetermined horizontal axis of said compressor casing;

a swash plate mounted on said drive shaft in said swash plate chamber to be rotatable with said drive shaft to thereby reciprocate said pistons for suction and compression;

a refrigerant and lubricant separating chamber provided in said compressor casing and having the lowest bottom level thereof located at a level higher than that of a surface of the given amount lubricant oil reserved in said oil sump and said swash plate chamber;

a communication passageway having a reduced cross-sectional area and provided with first and second ports, the first port opening toward said swash plate chamber and the second port opening toward said refrigerant and lubricant separating chamber to thereby provide a fluid communication between said swash plate chamber and said refrigerant and lubricant separating chamber;

a refrigerant evacuation passageway having a reduced cross-sectional area and extending from said refrigerant and lubricant separating chamber to the refrigerant suction side of said refrigerant circulating circuit, said refrigerant evacuation passageway having a first port opening toward said refrigerant and lubricant separating chamber and a second port opening toward said refrigerant suction side of said refrigerant circulating circuit; and, an arrangement in which the first opening of said refrigerant evacuation passageway is located at a position higher than the first opening of said communication passageway.

2. A swash plate type compressor having an internal refrigerant and lubricant separating system according to claim 1, wherein said compressor casing comprises a front cylinder block and a rear cylinder block connected together to form a cylinder block assembly and having said plurality of cylinder bores, a front and rear valve plates attached to opposite ends of said cylinder block assembly, and a front and a rear housings having suction and discharge chambers of said refrigerant circulating circuit, respectively, wherein said rear housing has a partition wall defining therein said refrigerant and lubricant separating chamber, and wherein said communication passageway comprises a linear through-hole formed in said rear cylinder block and having said first port located at a position higher than the surface of the given amount of lubricant oil reserved in said oil sump or said swash plate chamber and said second port located adjacent to said bottom of said refrigerant and lubricant separating chamber.

3. A swash plate type compressor having an internal refrigerant and lubricant separating system according to claim 2, wherein said refrigerant and lubricant separating chamber of said rear housing has an upper portion communicated with said swash plate chamber via a pressure equalizing passageway formed in said rear valve plate and said rear cylinder block.

4. A swash plate type compressor having an internal refrigerant and lubricant separating system according to claim 1, wherein said compressor casing comprises a front cylinder block and a rear cylinder block connected together to form a cylinder block assembly and having said plurality of cylinder bores, front and rear valve plates attached to opposite ends of said cylinder block assembly, and front and rear housings having suction and discharge chambers of said refrigerant circulating circuit, respectively, wherein said rear housing has a partition wall defining therein said refrigerant and lubricant separating chamber, and wherein said communication passageway comprises a gap formed around a rear end of said drive shaft and a bore formed in said rear valve plate, said bore being communicated with said gap and said refrigerant and lubricant separating chamber in said rear housing.

5. A swash plate type compressor having an internal refrigerant and lubricant separating system according to claim 1, wherein said compressor casing comprises front and rear cylinder blocks connected together to form a cylinder block assembly and having said plurality of cylinder bores, front and rear valve plates attached to opposite ends of said cylinder block assembly, and front and rear housings having suction and discharge chambers of said refrigerant circulating circuit, respectively, and wherein said front and rear cylinder blocks are provided with a pair of front and rear axially spaced bores arranged between two neighbouring cylinder bores of said plurality of said cylinder bores and formed as said refrigerant and lubricant separating chamber, each of said front and rear axial confined bores being communicated with said swash plate chamber via a through-hole which is formed in walls of said swash plate chamber as said communication passageway, said front and rear axial confined bores being further communicated with said refrigerant suction side of said refrigerant circulating circuit via a pair of passageway formed in said front and rear cylinder blocks as said refrigerant evacuation passageway.

6. A swash plate type compressor having an internal refrigerant and lubricant separating system according to claim 1, wherein said compressor casing comprises front and rear cylinder blocks connected together to form a cylinder block assembly and having said plurality of cylinder bores, front and rear valve plates attached to opposite ends of said cylinder block assembly, and front and a rear housings having suction and discharge chambers of said refrigerant circulating circuit, respectively, and wherein said front and rear cylinder blocks are provided with an axially extended bore at an upper portion of said cylinder block assembly with respect to said predetermined axis, said axially extended bore being disposed as said refrigerant and lubricant separating chamber and communicated with said swash plate chamber via a through-hole formed in an uppermost wall of said swash plate chamber, said axially extended bore being further communicated with said suction chambers of said front and rear housings via a pair of through-holes formed in said front and rear valve plates as said refrigerant evacuation passageway, respectively.

7. A swash plate type compressor having an internal refrigerant and lubricant separating system according to claim 1, wherein said compressor casing comprises front and rear cylinder blocks connected together to form a cylinder block assembly and having said plurality of cylinder bores, front and rear valve plates attached to opposite ends of said cylinder block assembly, and front and a rear housings having suction and discharge chambers of said refrigerant circulating circuit, respectively, and wherein said rear cylinder block is provided with an suction hole for introducing the refrigerant gas from outside said compressor and a vertically recessed chamber at a top of said rear cylinder block, said vertically recessed chamber being arranged as said refrigerant and lubricant separating chamber and having a bottom and a vertical wall, said vertically recessed chamber being further fluidly communicated with said suction hole via a first hole formed in said vertical wall as said refrigerant evacuation passageway and with said swash plate chamber via a second hole formed in said bottom as said communication passageway.

* * * * *